US009494910B2

(12) United States Patent
Ohata et al.

(10) Patent No.: US 9,494,910 B2
(45) Date of Patent: Nov. 15, 2016

(54) IMAGE FORMING APPARATUS COMPRISING BOARD HOLDING MEMBER CONFIGURED TO HAVE SURFACE TO WHICH BOARD IS FIXED

(71) Applicant: KYOCERA Document Solutions Inc., Osaka (JP)

(72) Inventors: Shinobu Ohata, Osaka (JP); Keiji Okumura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/884,082

(22) Filed: Oct. 15, 2015

(65) Prior Publication Data

US 2016/0109848 A1 Apr. 21, 2016

(30) Foreign Application Priority Data

Oct. 16, 2014 (JP) ..... 2014-211301

(51) Int. Cl.
*G03G 15/00* (2006.01)
*G03G 21/16* (2006.01)

(52) U.S. Cl.
CPC ..... *G03G 21/1619* (2013.01); *G03G 21/1652* (2013.01); *G03G 15/80* (2013.01); *G03G 2215/0132* (2013.01)

(58) Field of Classification Search
CPC .. G03G 15/00; G03G 15/80; G03G 21/1619; G03G 21/1652; G03G 2215/0004; G03G 2215/0016; G03G 2215/0132
USPC ..... 399/107, 110, 88, 90
See application file for complete search history.

(56) References Cited

U.S. PATENT DOCUMENTS

| | | | | |
|---|---|---|---|---|
| 7,734,214 | B2 * | 6/2010 | Masuda | G03G 21/1619 399/107 |
| 8,303,057 | B2 | 11/2012 | Kuramata et al. | |
| 8,693,913 | B2 * | 4/2014 | Ishizuka | G03G 15/80 399/88 |
| 8,810,833 | B2 * | 8/2014 | Suzuki | G03G 15/80 |

FOREIGN PATENT DOCUMENTS

| | | | |
|---|---|---|---|
| JP | H10-22655 | A | 1/1998 |
| JP | 2003-316232 | A | 11/2003 |
| JP | 2007-261240 | A | * 10/2007 |
| JP | 2009-115948 | A | 5/2009 |
| JP | 2011-237587 | A | 11/2011 |

OTHER PUBLICATIONS

An Office Action issued by the Japanese Patent Office on Aug. 30, 2016, which corresponds to Japanese Patent Application No. 2014-211301 and is related to U.S. Appl. No. 14/884,082.

* cited by examiner

*Primary Examiner* — Sophia S Chen
(74) *Attorney, Agent, or Firm* — Studebaker & Brackett PC

(57) ABSTRACT

An image forming apparatus includes an apparatus main body and a board holding member. The apparatus main body includes an image forming part. The board holding member is attached to the apparatus main body and configured to have a surface to which a board is fixed. The apparatus main body includes an engaging part and a supporting part. The engaging part is configured to engage with a side edge part of the board holding member. The supporting part is configured to support a part closer to an inside than the side edge part of the board holding member. The board holding member is rotated around the side edge part as a fulcrum so as to be opened and closed with respect to the apparatus main body.

9 Claims, 12 Drawing Sheets

IMAGE FORMING APPARATUS COMPRISING BOARD HOLDING MEMBER CONFIGURED TO HAVE SURFACE TO WHICH BOARD IS FIXED

INCORPORATION BY REFERENCE

This application is based on and claims the benefit of priority from Japanese patent application No. 2014-211301 filed on Oct. 16, 2014, the entire contents of which are incorporated herein by reference.

BACKGROUND

The present disclosure relates to an electrographic image forming apparatus.

Conventionally, an electrographic image forming apparatus is provided with various boards, such as a high-voltage board, an engine board or the like. As a configuration to attach these boards, for example, there is a configuration to arrange an electrical part at a side part of an apparatus main body of the image forming apparatus and to fix a board on a surface of a board holding member which is openably and closably attached to the electrical part.

In such a configuration, the board holding member is connected with the electrical part via a hinge member so that the board holding member is openable and closable with respect to the electrical part. When such a configuration is adopted, a structure to make the board holding member opened and closed with respect to the electrical part is complicated and there is a concern that the manufacturing cost of the image forming apparatus is increased. Also, there is a concern that attachment work of the board holding member to the electrical part is complicated because it is necessary to fix the board holding member and the hind member and to fix the electrical part and the hinge part when the board holding member is attached to the electrical part.

SUMMARY

In accordance with an embodiment of the present disclosure, an image forming apparatus includes an apparatus main body and a board holding member. The apparatus main body includes an image forming part. The board holding member is attached to the apparatus main body and configured to have a surface to which a board is fixed. The apparatus main body includes an engaging part and a supporting part. The engaging part is configured to engage with a side edge part of the board holding member. The supporting part is configured to support a part closer to an inside than the side edge part of the board holding member. The board holding member is rotated around the side edge part as a fulcrum so as to be opened and closed with respect to the apparatus main body.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
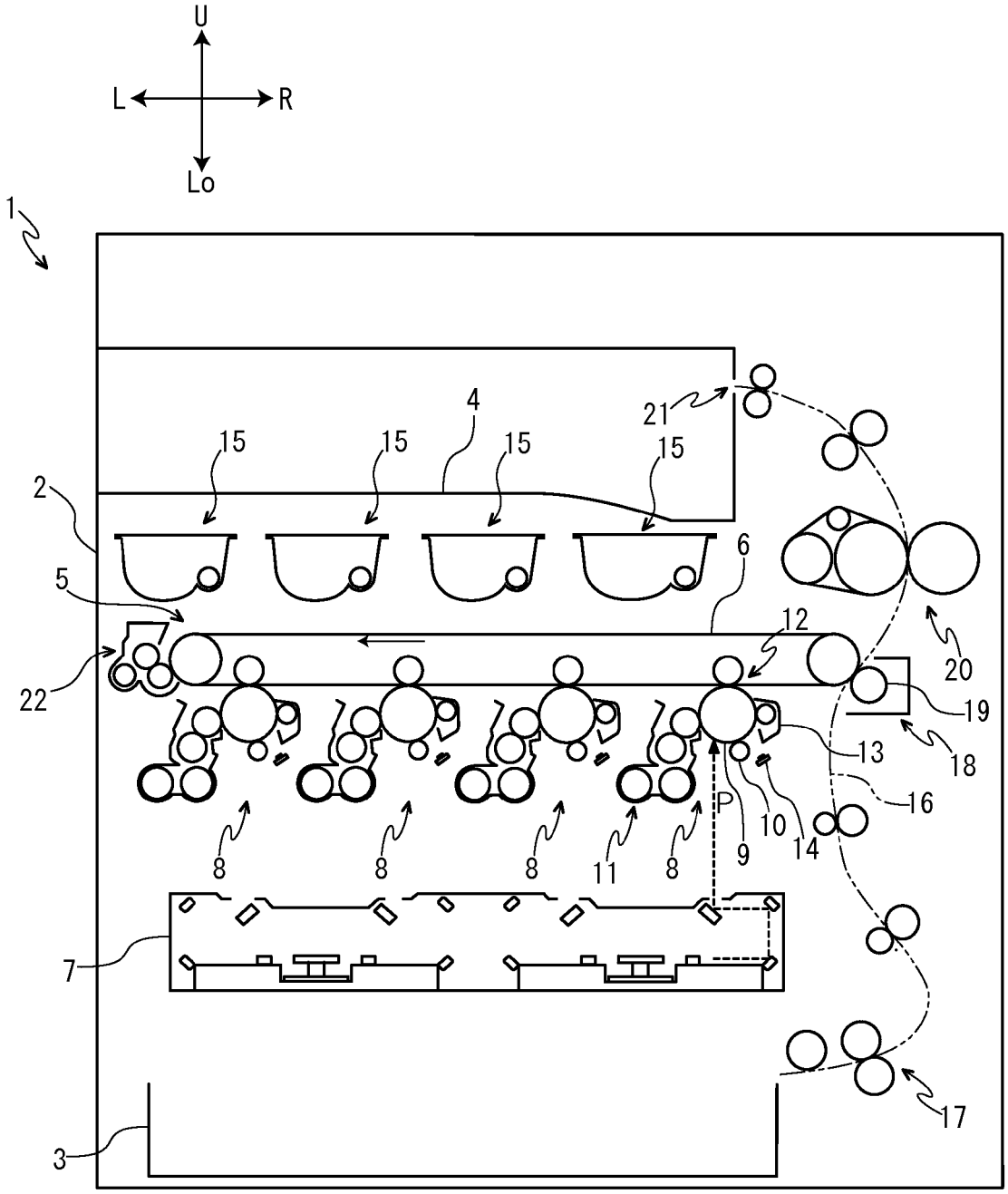
FIG. 1 is a schematic diagram showing an outline of a configuration of a color printer according to an embodiment of the present disclosure.

Firstly, with reference to FIG. 1, the entire structure of a color printer 1 (an image forming apparatus) will be described. Hereinafter, a near side of FIG. 1 will be described as a front side of the color printer 1, for convenience of explanation. Arrows Fr, Rr, L, R, U and Lo of each figure indicate a front side, a rear side, a left side, a right side, an upper side and a lower side of the color printer 1, respectively.

The color printer 1 includes a box-formed printer main body 2 (apparatus main body). In a lower part of the printer main body 2, a sheet feeding cartridge 3 storing a sheet (a recording medium) is arranged. In an upper part of the printer main body 2, an ejected sheet tray 4 is arranged.

In a middle part of the printer main body 2, an intermediate transferring unit 5 is arranged. The intermediate transferring unit 5 is provided with an intermediate transferring belt 6 disposed around a plurality of rollers. Below the intermediate transferring belt 6, an exposure device 7 composed of a laser scanning unit (LSU) is arranged. At a lower side of the intermediate transferring belt 6, four image forming parts 8 are arranged for respective colors (e.g. four colors of magenta, cyan, yellow and black) of a toner. In each image forming part 8, a photosensitive drum 9 is rotatably arranged. Around the photosensitive drum 9, a charger 10, a developing device 11, a primary transferring part 12, a cleaning device 13 and a static eliminator 14 are located in order of first transferring processes. Above the developing device 11, toner containers 15 corresponding to the respective image forming parts 8 are arranged for the respective colors (e.g. four colors of magenta, cyan, yellow and black) of toner.

At a right side part of the printer main body 2, a conveying path 16 for the sheet is arranged in an upper and lower direction. At an upstream end of the conveying path 16, a sheet feeding part 17 is arranged. At an intermediate stream part of the conveying path 16, a secondary transferring unit 18 is arranged at a right end side of the intermediate transferring belt 6. The secondary transferring unit 18 includes a secondary transferring roller 19. At a downstream part of the conveying path 16, a fixing device 20 is arranged. At a downstream end of the conveying path 16, a sheet ejection port 21 is arranged. At a left end side of the intermediate transferring belt 6, a cleaning unit 22 is arranged.

Next, an image forming process on the sheet in the color printer 1 having such a configuration will be described.

When the power is supplied to the color printer 1, various parameters are initialized and initial determination, such as temperature determination of the fixing device 20, is carried out. Subsequently, when image data is inputted and a printing start is directed from a computer or the like connected with the color printer 1, the image forming process on the sheet is carried out as follows.

Firstly, the surface of the photosensitive drum 9 is electrically charged by the charger 10. Then, an electrostatic latent image is formed on the surface of the photosensitive drum 9 by a laser light (refer to an arrow P) from the exposure device 7. The electrostatic latent image is developed to a toner image in the developing device 11 by the toner supplied from each toner container 15. The toner image is primarily transferred to the surface of the intermediate transferring belt 6 in the primary transferring part 12. The above-mentioned operation is repeated in order by the respective image forming parts 8, thereby forming the toner image of full color on the intermediate transferring belt 6. Incidentally, toner and electric charge remained on the photosensitive drum 9 are removed by the cleaning device 13 and the static eliminator 14.

On the other hand, the sheet fed from the sheet feeding cartridge 3 or a manual bypass tray (not shown) by the sheet feeding part 17 is conveyed to the secondary transferring unit 18. Then, by the secondary transferring roller 19, the toner image of full color on the intermediate transferring belt 6 is secondary transferred to the sheet. The sheet with the secondary transferred toner image is conveyed to a downstream side on the conveying path 16 to enter the fixing device 20, and then, the toner image is fixed on the sheet in the fixing device 20. The sheet with the fixed toner image is ejected from the sheet ejection port 21 on the ejected sheet tray 4. Incidentally, the toner remained on the intermediate transferring belt 6 is removed by the cleaning unit 22.

Next, the printer main body 2 and its periphery will be further described. Hereinafter, an "inside" and an "outside" refer to an "inside" and an "outside" in a left and right direction.

Figure 2:
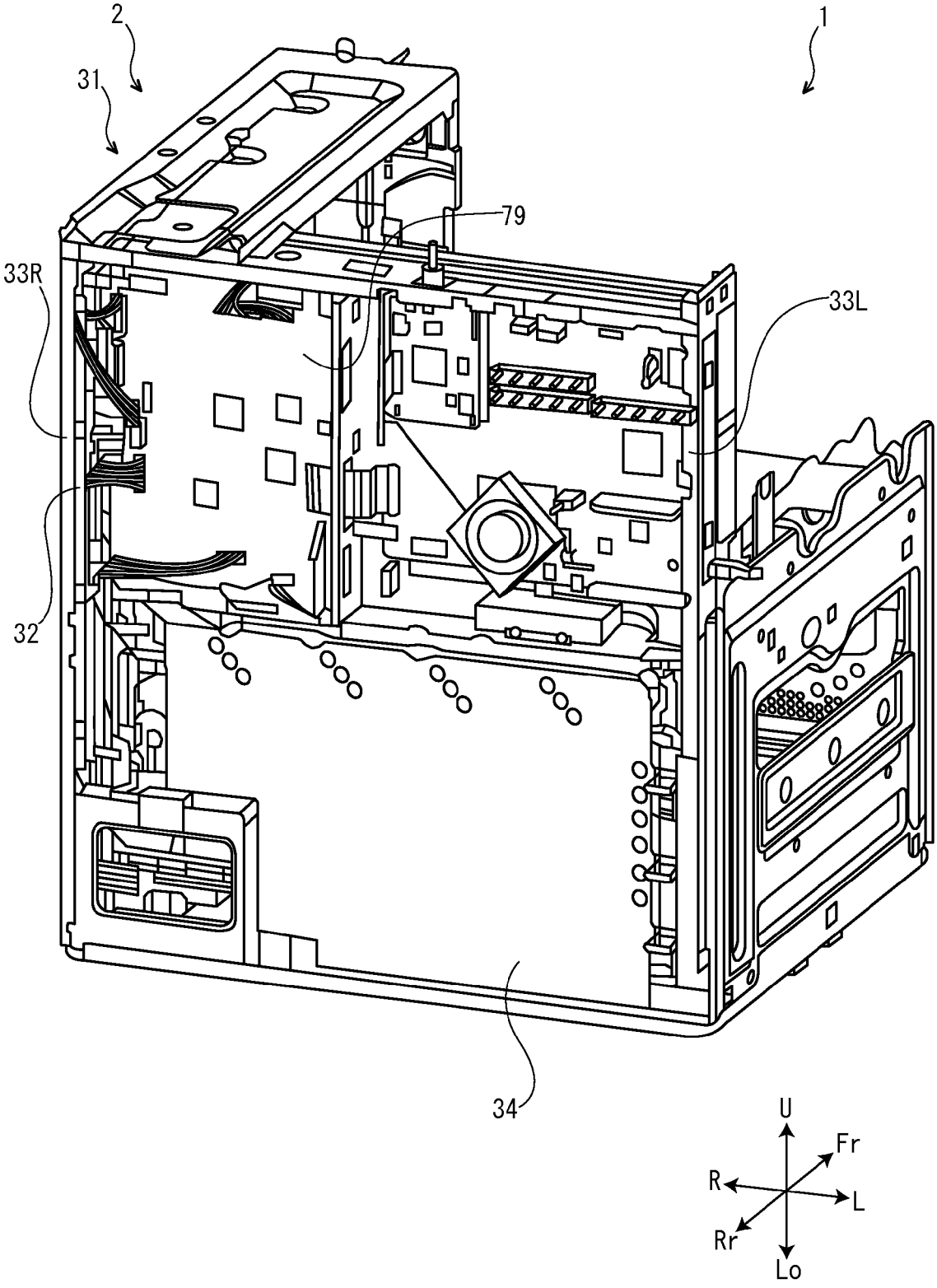
FIG. 2 is a perspective view showing the color printer according to the embodiment of the present disclosure.

As shown in FIG. 2, the printer main body 2 includes a main body frame 31 and a guiding member 32 attached to a rear right part of the main body frame 31.

The main body frame 31 of the printer main body 2 is formed in a square frame shape. The outer circumference of the main body frame 31 is covered by an exterior cover (not shown). At a rear right corner of the main body frame 31, a holding frame 33R is set up, and, at a rear left corner of the main body frame 31, a holding frame 33L is set up. Between the holding frame 33R and the holding frame 33L, a high-voltage board 34 is set up. The high-voltage board 34 is connected to a unit (e.g. the secondary transfer unit 18) used for image forming process on the sheet.

Figure 3:
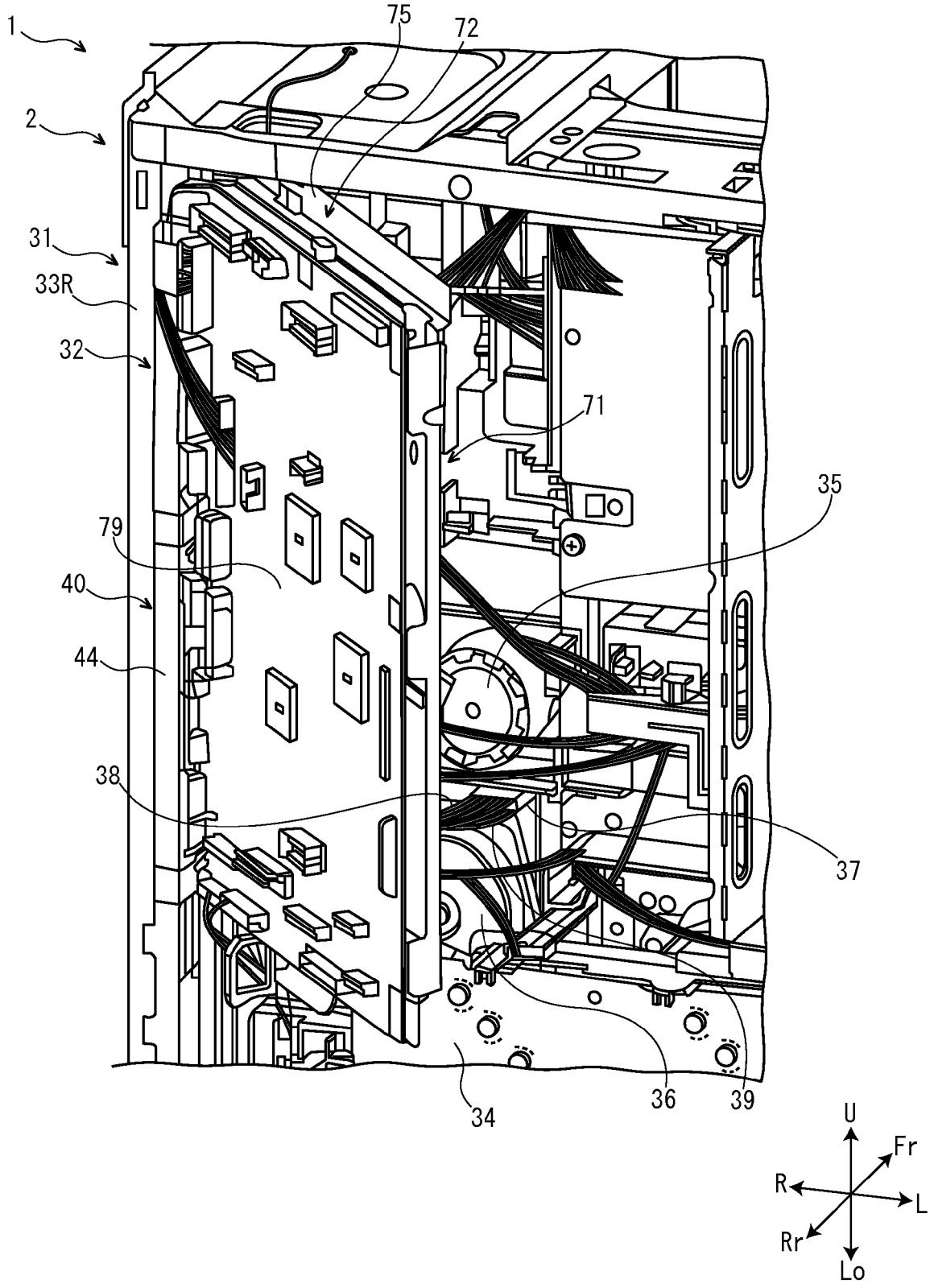
FIG. 3 is a perspective view showing a state where a board holding member is opened, in the color printer according to the embodiment of the present disclosure.

As shown in FIG. 3, at a rear end part of the main body frame 31, and, above the high-voltage board 34, a first motor 35 and a second motor 36 are housed. The first motor 35 is connected to a unit (e.g. a fixing unit including the fixing device 20) used for the image forming process on the sheet. The second motor 36 is connected to a unit (e.g. a sheet conveying unit (not shown)) used for the image forming process on the sheet. At the rear end part of the main body frame 31, a connector 37 is housed between the first motor 35 and the second motor 36. The connector 37 couples a wire 38 and a wire 39.

Figure 4:
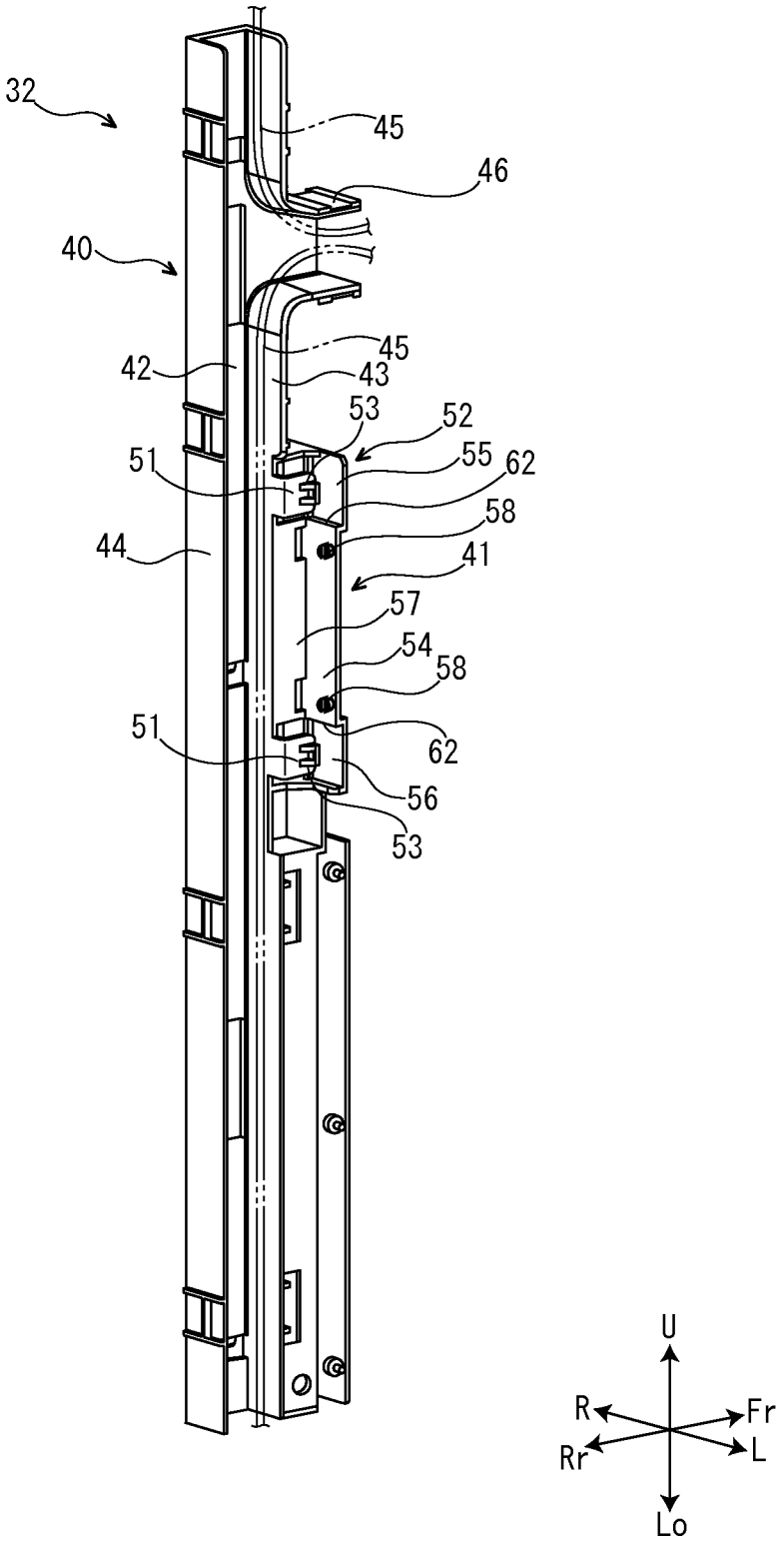
FIG. 4 is a perspective view showing a guiding member, in the color printer according to the embodiment of the present disclosure.

The guiding member 32 of the printer main body 2 is made of a resin, for example. The guiding member 32 is fixed to the holding frame 33R of the main body frame 31. As shown in FIG. 4, the guiding member 32 includes a guiding frame 40 extending in the upper and lower direction, and a supporting piece 41 which is protruded forward from an upper-and-lower direction center part of the guiding frame 40.

The guiding frame 40 of the guiding member 32 includes a bottom wall part 42, and both front and rear wall parts 43 and 44 which are protruded leftward from both front and rear end parts of the bottom wall part 42, and is formed in a U shape by a plan view. In a space at an inside of the guiding frame 40, a wire 45 is arranged in a state where the wire 45 is guided by the both front and rear wall parts 43 and 44. At an upper part of the front wall part 43, a lead-out port 46 is formed forward, and, from the space at the inside of the guiding frame 40, the wire 45 can be led forward through the lead-out port 46.

Figure 5:
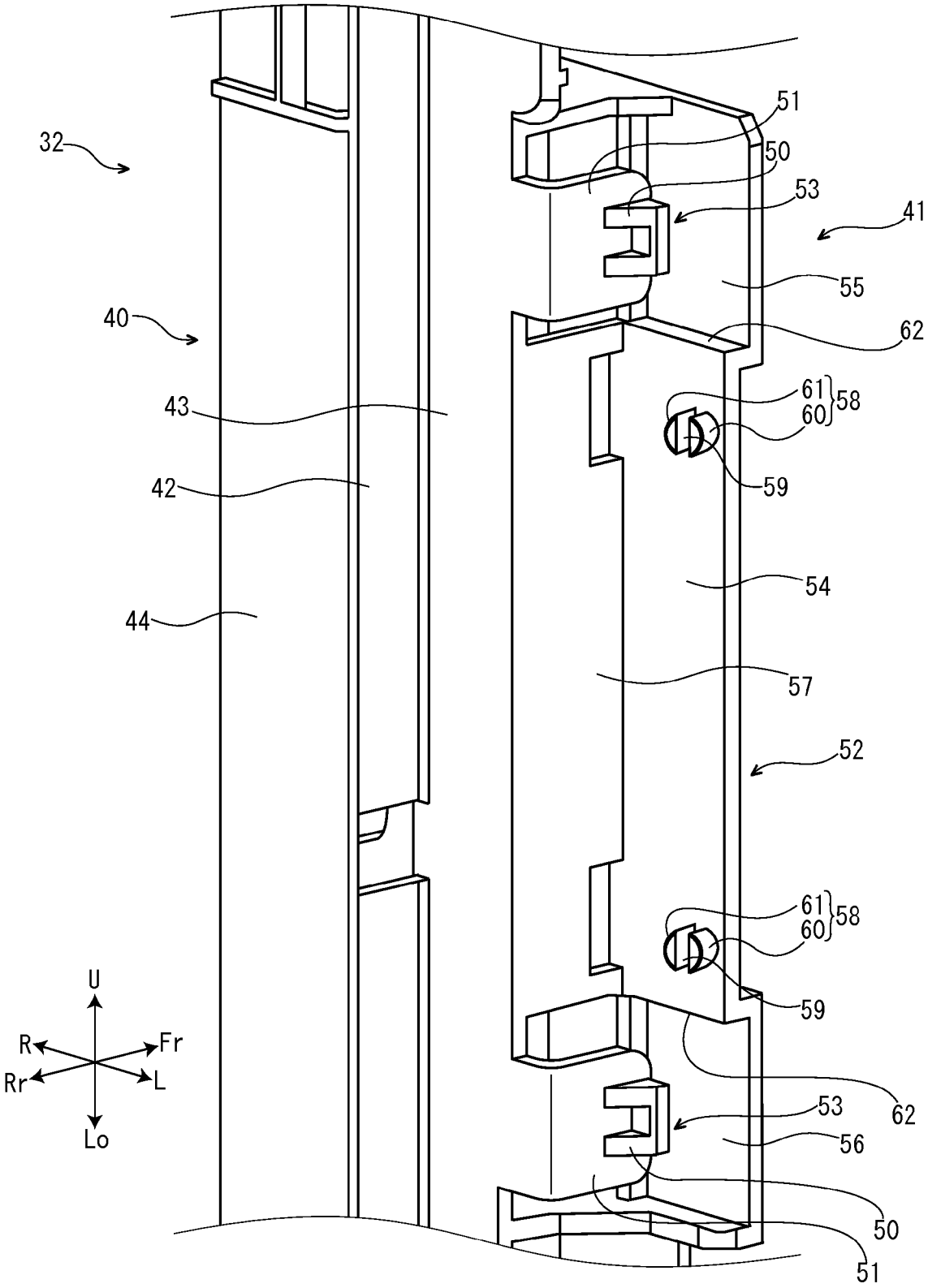
FIG. 5 is a perspective view showing a supporting piece and its periphery of the guiding member, in the color printer according to the embodiment of the present disclosure.

As shown in FIG. 5, the supporting piece 41 of the guiding member 32 includes a pair of upper and lower first wall parts 51, and a second wall part 52 arranged closer to the front side than each first wall part 51.

Each first wall part 51 of the supporting piece 41 is bent forward from a left end part (distal end part) of the front wall part 43 of the guiding frame 40. On an inside face (left face) of each first wall part 51, a rib (engaging part) is protruded. Each rib 53 has a function of so-called "snap fit". At a part from a rear end part to a front part of each rib 53, an expanded width part 50 whose width is gradually expanded forward is formed.

The second wall part 52 of the supporting piece 41 includes a center plate 54, and both upper and lower plates 55 and 56 provided at both of upper and lower sides of the center plate 54. A right end part of the center plate 54 is coupled to a left end part (distal end part) of the front wall part 43 of the guiding frame 40 by a coupling wall part 57. On an upper part and a lower part of a surface (rear face) of the center plate 54, bosses 58 (supporting parts) are protruded. Each boss 58 is divided into an inside part 60 (a left side part in the present embodiment) and an outside part 61 (a right side part in the present embodiment) by a dividing slot 59 formed along the upper and lower direction. The dividing slot 59 is formed from a proximal end part to a distal end part of each boss 58. A protruding length of the inside part 60 of each boss 58 from the surface of the center plate 54 is the same as a protruding length of the outside part 61 of each boss 58 from the surface of the center plate 54. Between the center plate 54 and the both upper and lower plates 55 and 56, steps 62 are formed, and the center plate 54 is arranged closer to a rear side (a side which is close to each rib 53 of each first wall part 51) than the both upper and lower plates 55 and 56. The both upper and lower plates 55 and 56 face the ribs 53 with an interval, respectively.

Figure 6:
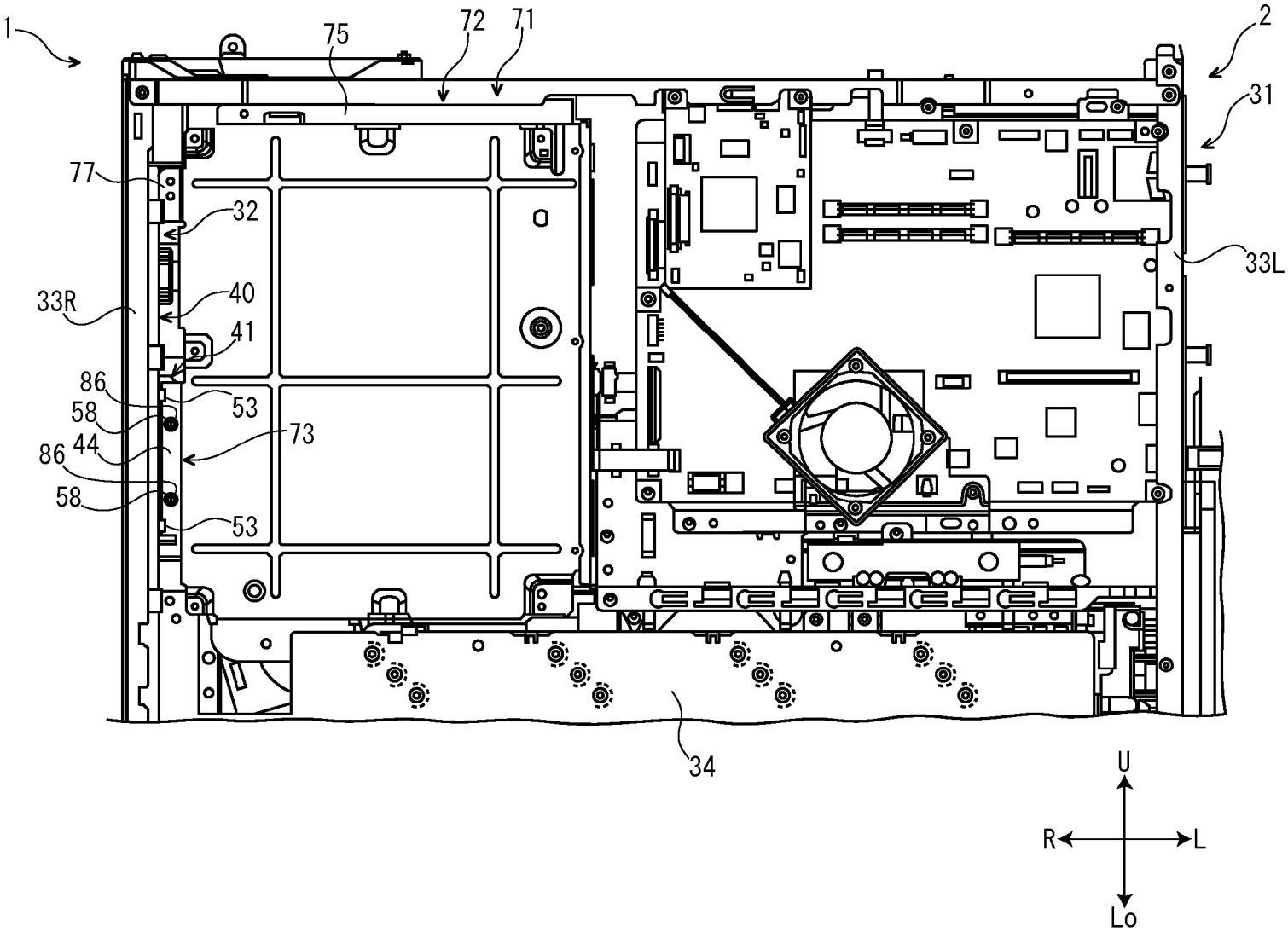
FIG. 6 is a rear view showing the color printer according to the embodiment of the present disclosure.

As shown in FIG. 6, at a rear end part of the printer main body 2, a board holding member 71 is attached. The board holding member 71 and its periphery will be described in detail below.

Figure 7:
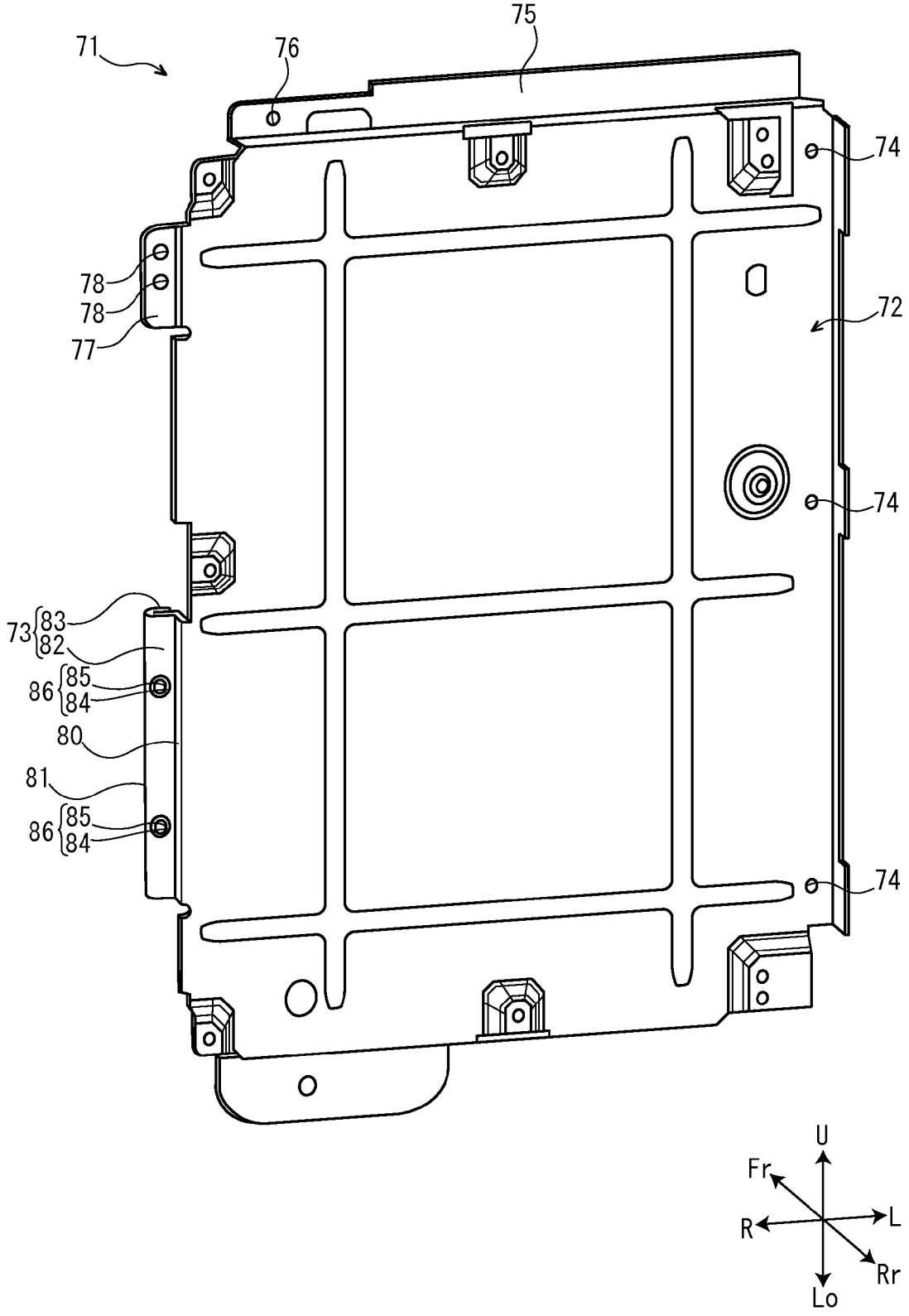
FIG. 7 is a perspective view showing the board holding member, in the color printer according to the embodiment of the present disclosure.

The board holding member 71 is made of a sheet metal, for example. The left and right direction is a width direction of the board holding member 71. As shown in FIG. 7, the board holding member 71 includes a rectangular main body part 72, and an attachment part 73 which is protruded rightward from a lower part of a right end part of the main body part 72.

At a left end part of the main body part 72 of the board holding member 71, and at the center part in the upper and lower direction and the both upper and lower end parts, screw holes 74 are formed. At an upper end part of the main body part 72, an upper end plate 75 elongated in the left and right direction is formed. At a right side part of the upper end plate 75, a screw hole 76 is formed. At an upper part of the right end part of the main body part 72, a tongue piece 77 is protruded rightward. The tongue piece 77 is provided with a pair of upper and lower screw holes 78. Fastening screws (not shown) are inserted into each screw hole 74, the screw hole 76 and each screw hole 78, and each fastening screw fastens the board holding member 71 and the printer main body 2.

As shown in FIG. 3, to a surface of the main body part 72 of the board holding member 71, an engine board 79 is fixed by a plurality of screws (not shown). In addition, the engine board 79 is not shown except in FIGS. 2 and 3.

Figure 8:
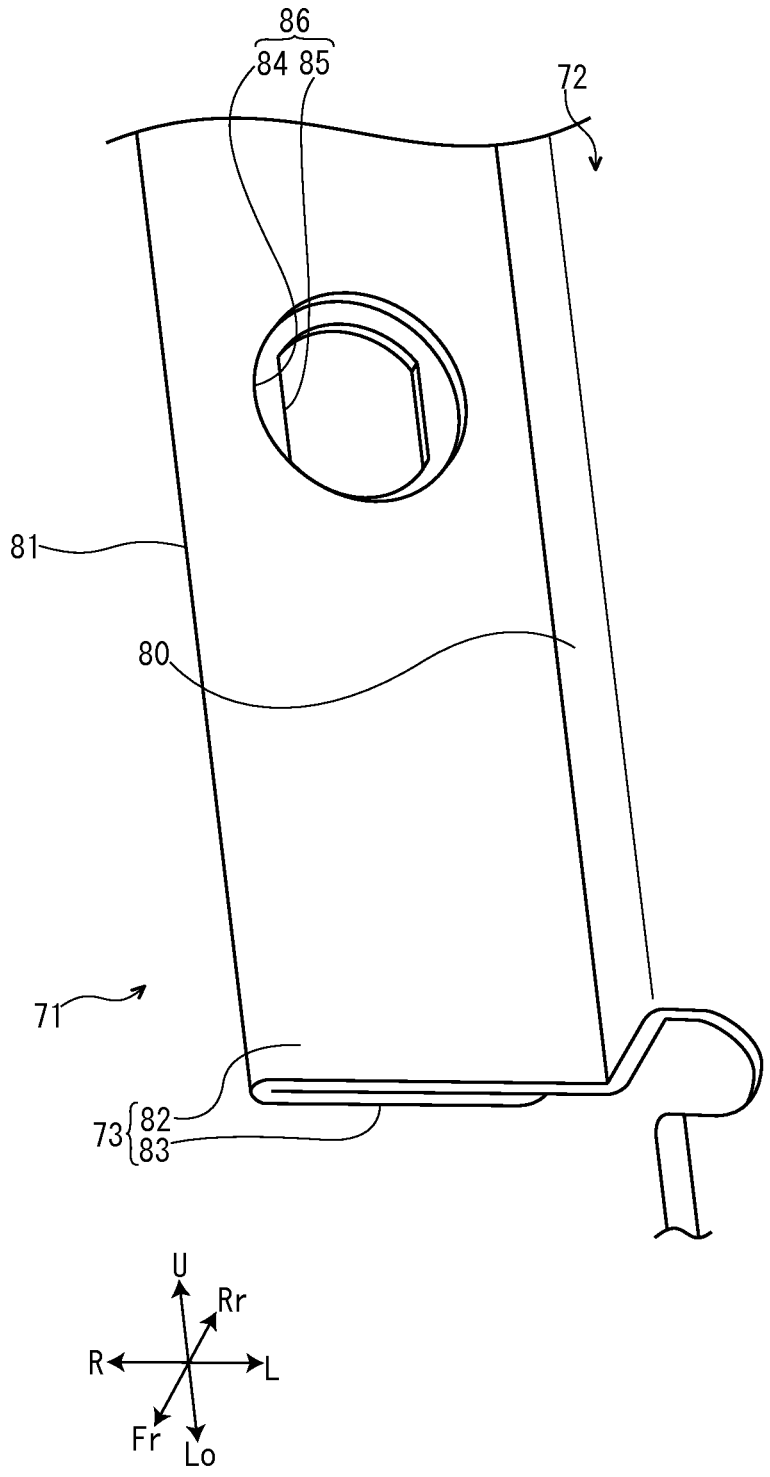
FIG. 8 is a perspective view showing an attachment part and its periphery of the board holding member, in the color printer according to the embodiment of the present disclosure.
Figure 9:
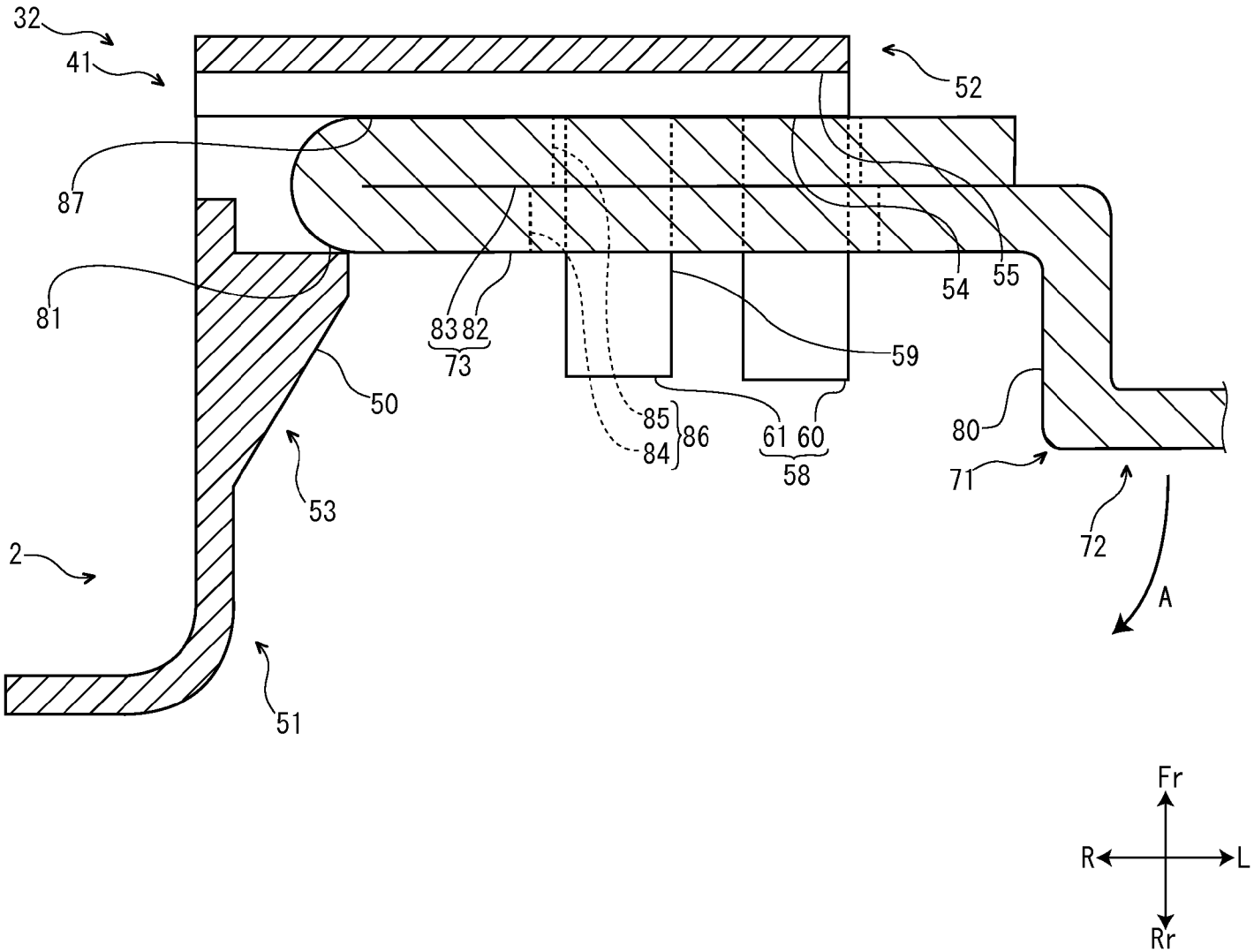
FIG. 9 is a sectional view showing a state where the board holding member is closed, in the color printer according to the embodiment of the present disclosure.

As shown in FIGS. 7 to 9, between the main body part 72 and the attachment part 73 of the board holding member 71, a step part 80 is formed. Hence, the attachment part 73 is arranged closer to the front side than the main body part 72. At an outside (right side) of the attachment part 73, each first wall part 51 of the supporting piece 41 of the guiding member 32 is provided, and, at a back face side of the attachment part 73, the second wall part 52 of the supporting piece 41 of the guiding member 32 is provided.

A right side edge part 81 of the attachment part 73 of the board holding member 71 (also corresponding to a right side edge part of the board holding member 71 as a whole) is folded back by hemming bending (a method of bending a sheet metal 180 degrees), and is curved in an arc shape. The right side edge part 81 of the attachment part 73 is inserted into the facing intervals between each rib 53 of the supporting piece 41 of the guiding member 32 and the both upper and lower plates 55 and 56 of the second wall part 52, and engages with each rib 53.

The attachment part 73 of the board holding member 71 includes a top side part 82 and a back side part 83. At an upper part and a lower part of the attachment part 73, through-holes 86 are formed closer to an inside (left side) than the right side edge part 81. In each through-hole 86, each boss 58 of the supporting piece 41 of the guiding member 32 penetrates. Thus, a part closer to the inside than the right side edge part 81 of the attachment part 73 is supported by each boss 58. A part 84 of each through-hole 86 meeting the top side part 82 of the attachment part 73 is formed in a precise circle. A part 85 of each through-hole 86 meeting the back side part 83 of the attachment part 73 is formed in an elongated hole shape elongated in the upper and lower direction, and has a narrower vertical width and a horizontal width than the part 84 of each through-hole 86 meeting the top side part 82 of the attachment part 73.

During normal use of the color printer 1 applying the above configuration, as shown in FIG. 9, the board holding member 71 is closed with respect to the printer main body 2. Further, fastening screws (not shown) inserted into each screw hole 74, the screw hole 76 and each screw hole 78 (see FIG. 7) fasten the board holding member 71 and the printer main body 2.

Figure 10:
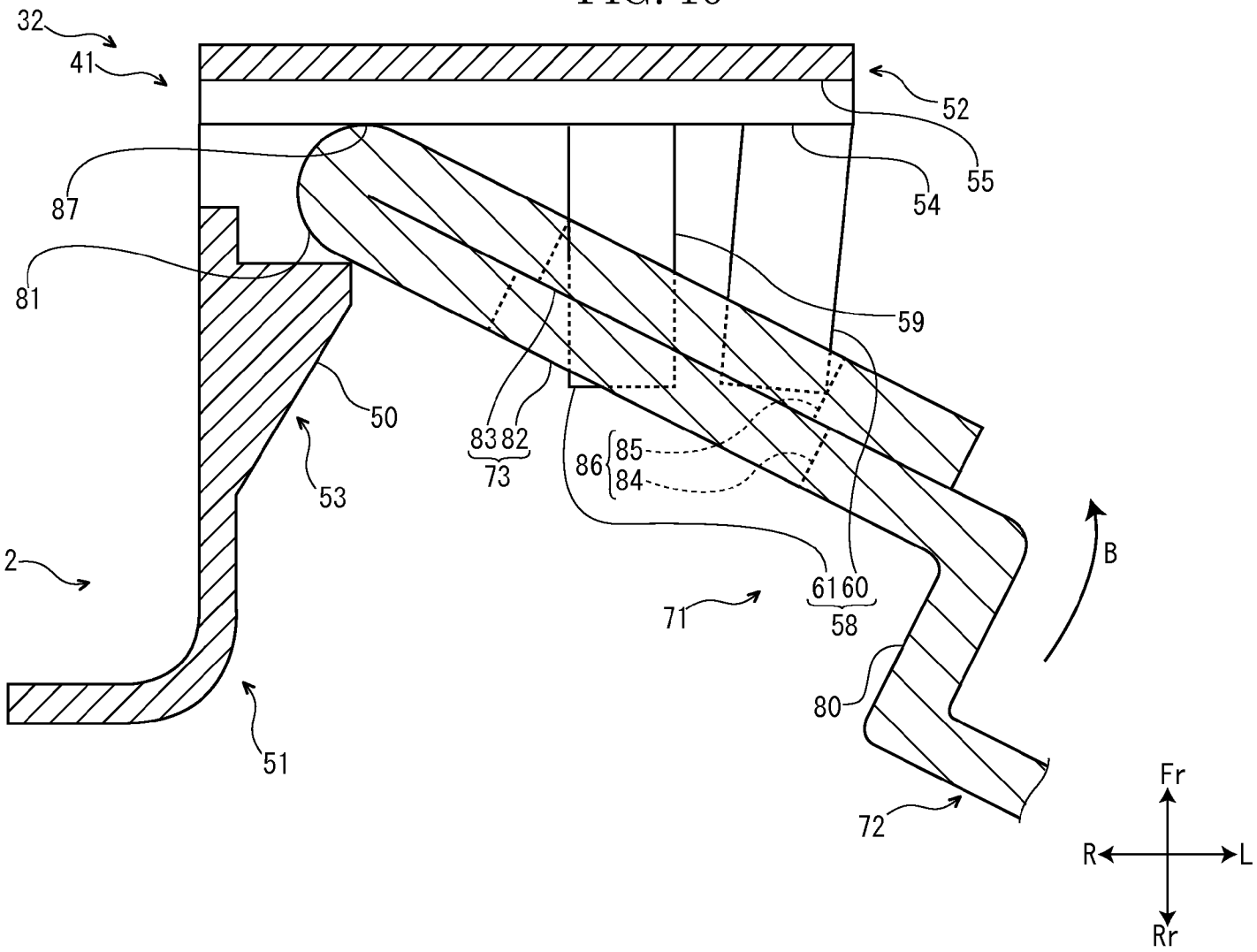
FIG. 10 is a sectional view showing the state where the board holding member is opened, in the color printer according to the embodiment of the present disclosure.

Meanwhile, when maintenance of electrical parts (e.g. the first motor 35, the second motor 36 or the connector 37) arranged at the back face side of the board holding member 71 is carried out, the fastening screws inserted into each screw hole 74, the screw hole 76 and each screw hole 78 are removed, and the fastening of the board holding member 71 and the printer main body 2 is released. Next, as indicated by an arrow A in FIG. 9, the board holding member 71 is rotated backward around the right side edge part 81 of the attachment part 73 as a fulcrum. According to this, as shown in FIG. 10, the board holding member 71 is opened with respect to the printer main body 2. A maximum rotation angle (maximum opening angle) of the board holding member 71 is 45 degrees, for example.

In a state where the board holding member 71 is opened with respect to the printer main body 2 as described above, the maintenance of the electrical parts is carried out. Further, when the maintenance of the electrical parts is finished, as indicated by arrow B in FIG. 10, the board holding member 71 is rotated forward around the right side edge part 81 of the attachment part 73 as the fulcrum. According to this, as shown in FIG. 9, the board holding member 71 is closed with respect to the printer main body 2. Finally, the fastening screws (not shown) are inserted into each screw hole 74, the screw hole 76 and each screw hole 78 so as to fasten the board holding member 71 and the printer main body 2.

In the present embodiment, as described above, by rotating the board holding member 71 around the right side edge part 81 of the attachment part 73 as the fulcrum, the board holding member 71 is opened and closed with respect to the printer main body 2. Consequently, it is possible to easily make an access to the electrical parts arranged on the back face side of the board holding member 71, and enhance maintenance of the electrical parts.

Further, it is possible to open and close the board holding member 71 with respect to the printer main body 2 while employing a simple configuration without using a hinge member or the like. According to this, it is possible to reduce manufacturing cost of the color printer 1.

Further, by engaging the right side edge part 81 of the attachment part 73 with each rib 53 of the supporting piece 41 of the guiding member 32, and having each boss 58 of the supporting piece 41 of the guiding member 32 penetrate each through-hole 86 of the attachment part 73, it is possible to attach the board holding member 71 to the printer main body 2. Thus, according to the present embodiment, by attaching the board holding member 71 to the printer main body 2 by using so-called "snap fit", it is possible to easily attach the board holding member 71 to the printer main body 2.

Further, the engine board 79 is fixed to the surface of the main body part 72 of the board holding member 71, so that it is possible to easily exchange the engine board 79.

Furthermore, each boss 58 is divided into the inside part 60 and the outside part 61 by the dividing slot 59 formed along the upper and lower direction. Hence, as shown in FIG. 10, when the board holding member 71 is opened, it is possible to elastically deform the inside part 60 of each boss 58 toward the outside (right side), and prevent each boss 58 from being damaged.

Further, each rib 53 and each boss 58 are provided at the guiding member 32 which guides the wire 45. By applying this configuration, it is possible to use the guiding member 32 which guides the wire 45 as a supporting member of the board holding member 71. According to this, it is possible to prevent the configuration of the color printer 1 from becoming complicated.

Further, the right side edge part 81 of the attachment part 73 of the board holding member 71 is folded back by hemming bending. Consequently, it is possible to prevent the right side edge part 81 of the attachment part 73 and each rib 53 of the supporting piece 41 of the guiding member 32 from being caught by each other, and smoothly engage the right side edge part 81 of the attachment part 73 with each rib 53.

Figure 11:
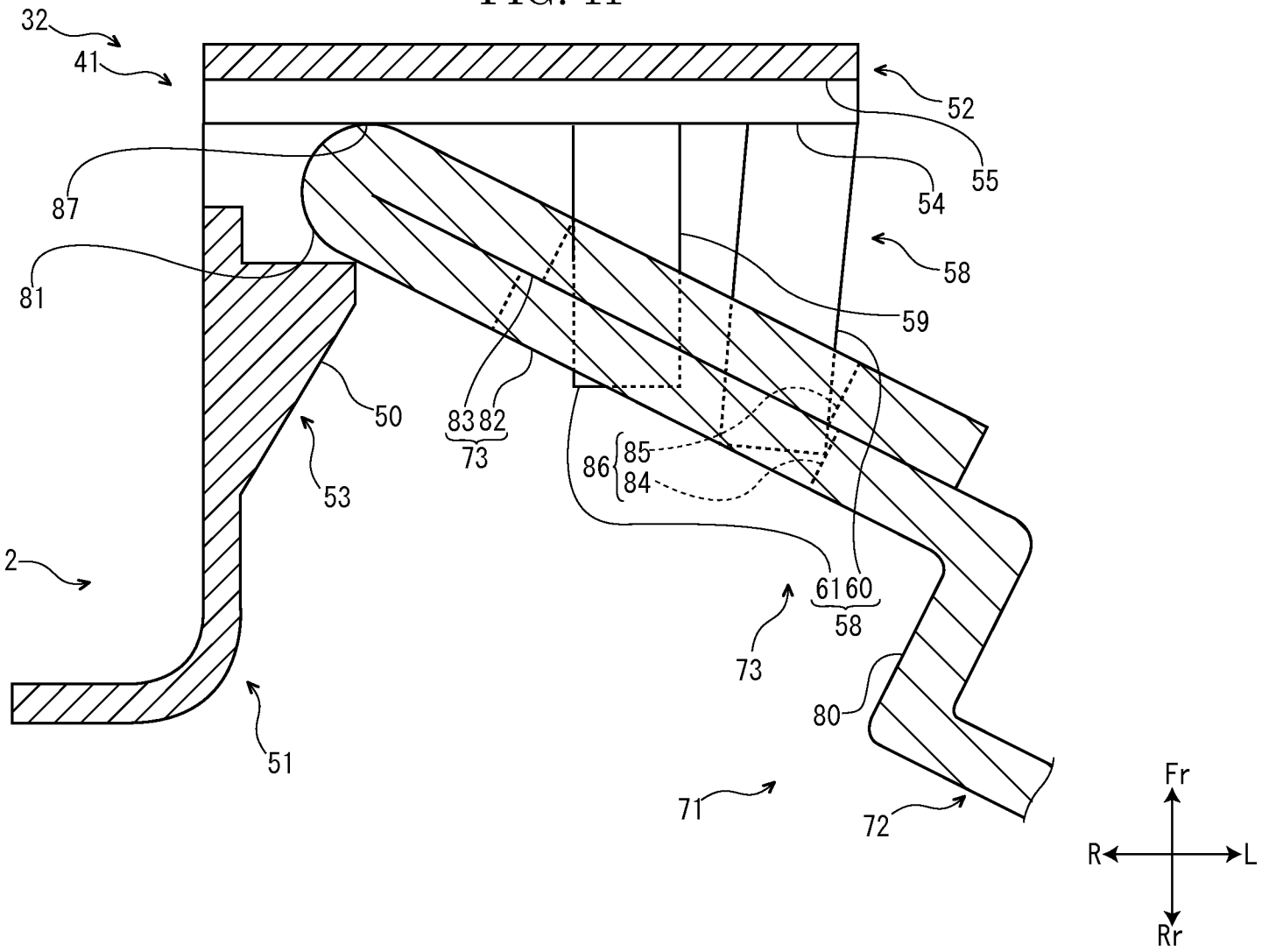
FIG. 11 is a sectional view showing a state where a board holding member is opened, in a color printer according to another embodiment of the present disclosure.

In the present embodiment, the protruding length of the inside part 60 of each boss 58 from the surface of the center plate 54 of the second wall part 52 is the same as the protruding length of the outside part 61 of each boss 58 from the surface of the center plate 54 of the second wall part 52. In another embodiment, as shown in FIG. 11, the protruding length of the inside part 60 of each boss 58 from the surface of the center plate 54 of the second wall part 52 may be longer than the protruding length of the outside part 61 of each boss 58 from the surface of the center plate 54 of the second wall part 52. By applying such a configuration, it is possible to prevent each boss 58 and each through-hole 86 from being unintentionally disengaged when the board holding member 71 is opened.

In the present embodiment, the dividing slot 59 is formed from the proximal end part to the distal end part of each boss 58. In another embodiment, the dividing slot 59 may be formed only at an distal end part of each boss 58 or may not be formed.

Figure 12:
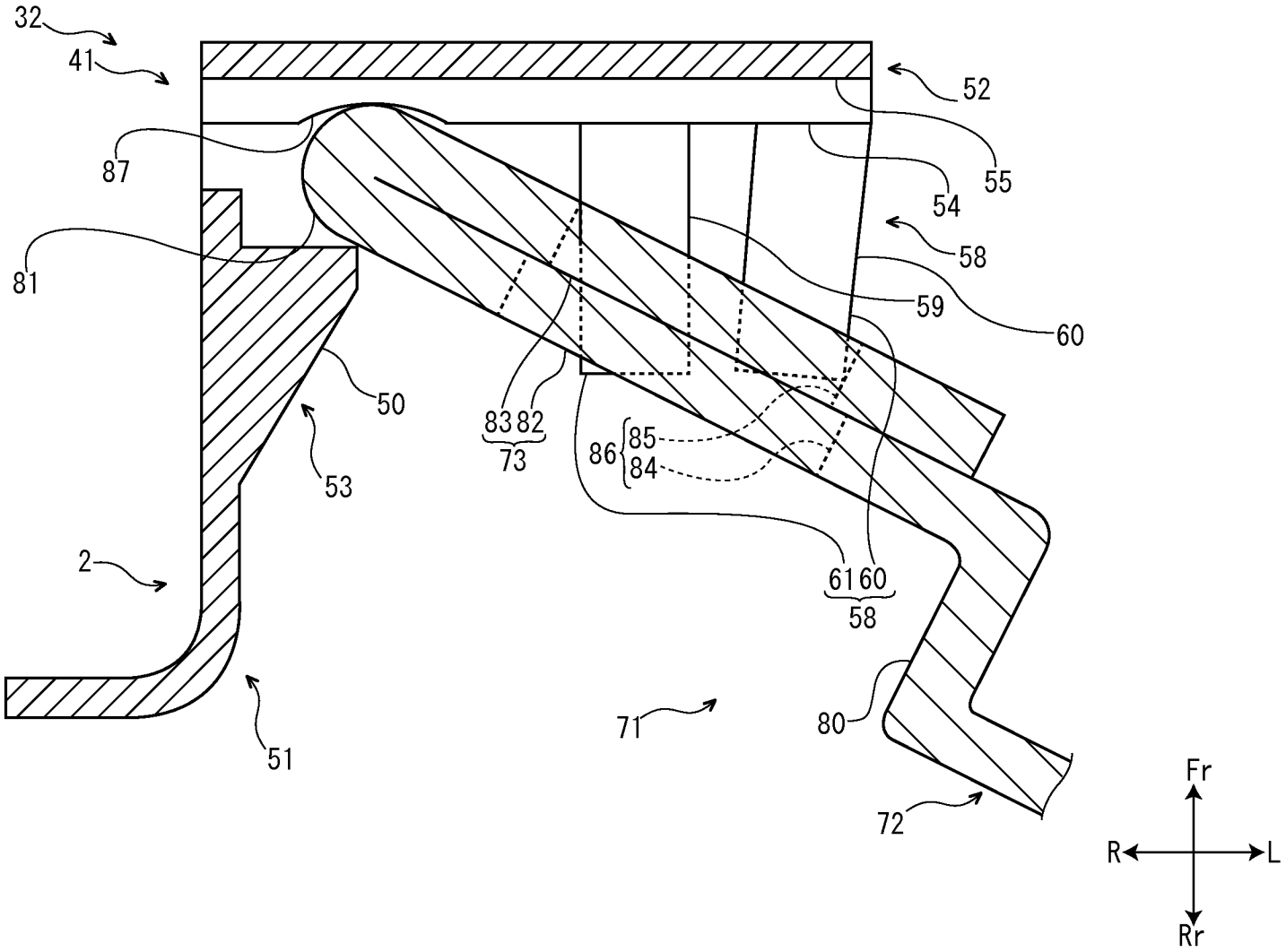
FIG. 12 is a sectional view showing a state where a board holding member is opened, in a color printer according to still another embodiment of the present disclosure.

In the present embodiment, a contact part 87 which is formed on the surface of the second wall part 52 and configured to come into contact with the right side edge part 81 of the attachment part 73 during a rotation of the board holding member 71 is flat (refer to FIGS. 9 and 10). In another embodiment, as shown in FIG. 12, the contact part 87 which is formed on the surface of the second wall part 52 and configured to come into contact with the right side edge part 81 of the attachment part 73 during the rotation of the board holding member 71 may be curved in an arc shape. By applying such a configuration, it is possible to smoothly rotate the board holding member 71.

In the present embodiment, the configuration of the present disclosure is applied to the color printer 1. In another embodiment, the configuration of the present disclosure may be applied to another image forming apparatus, such as a monochrome printer, a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an apparatus main body including an image forming part; and a board holding member attached to the apparatus main body and configured to have a surface to which a board is fixed, wherein the apparatus main body includes:

a first wall part provided at an outside of the board holding member;

a second wall part provided at a back face side of the board holding member;

an engaging part configured to engage with a side edge part of the board holding member; and a supporting part configured to support a part closer to an inside than the side edge part of the board holding member, the engaging part is a rib protruded on an inside face of the first wall part, the supporting part is a boss protruded on a surface of the second wall part, at the part closer to the inside than the side edge part of the board holding member, a through-hole which the boss penetrates is formed, and the board holding member is rotated around the side edge part as a fulcrum so as to be opened and closed with respect to the apparatus main body.

2. The image forming apparatus according to claim 1, wherein the boss is divided into an inside part and an outside part by a dividing slot formed along an upper and lower direction.

3. The image forming apparatus according to claim 2, wherein a protruding length of the inside part of the boss from the surface of the second wall part is longer than a protruding length of the outside part of the boss from the surface of the second wall part.

4. The image forming apparatus according to claim 2, wherein a protruding length of the inside part of the boss from the surface of the second wall part is the same as a protruding length of the outside part of the boss from the surface of the second wall part.

5. The image forming apparatus according to claim 2, wherein the dividing slot is formed from a proximal end part to a distal end part of the boss.

6. The image forming apparatus according to claim 1, wherein the surface of the second wall part has a contact part configured to come into contact with the side edge part of the board holding member during a rotation of the board holding member, the contact part being curved in an arc shape.

7. The image forming apparatus according to claim 1, wherein the side edge part of the board holding member is folded back by hemming bending.

8. An image forming apparatus comprising:

an apparatus main body including an image forming part; and a board holding member attached to the apparatus main body and configured to have a surface to which a board is fixed, wherein the apparatus main body includes:

an engaging part configured to engage with a side edge part of the board holding member;

a supporting part configured to support a part closer to an inside than the side edge part of the board holding member; and a guiding member configured to guide a wire, the engaging part and the supporting part are provided at the guiding member, and the board holding member is rotated around the side edge part as a fulcrum so as to be opened and closed with respect to the apparatus main body.

9. The image forming apparatus according to claim 7, wherein the guiding member includes:

a guiding frame extending in an upper and lower direction; and a supporting piece protruded from the guiding frame, in a space at an inside of the guiding frame, the wire is arranged, the engaging part and the supporting part are provided at the supporting piece.

* * * * *